US009291073B2

(12) United States Patent
Naβ

(10) Patent No.: US 9,291,073 B2
(45) Date of Patent: Mar. 22, 2016

(54) CENTERING ATTACHMENT OF A COMPRESSOR HOUSING COVER

(75) Inventor: Dieter Naβ, Moers (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 412 days.

(21) Appl. No.: 13/825,035

(22) PCT Filed: Sep. 22, 2011

(86) PCT No.: PCT/EP2011/066485

§ 371 (c)(1),
(2), (4) Date: Mar. 19, 2013

(87) PCT Pub. No.: WO2012/041757

PCT Pub. Date: Apr. 5, 2012

(65) Prior Publication Data

US 2013/0183147 A1 Jul. 18, 2013

(30) Foreign Application Priority Data

Sep. 22, 2010 (DE) ..... 10 2010 041 210

(51) Int. Cl.

| | |
|---|---|
| ***F01D 25/24*** | (2006.01) |
| ***F04D 29/54*** | (2006.01) |
| ***F01D 11/04*** | (2006.01) |
| ***F01D 25/14*** | (2006.01) |
| ***F04D 29/08*** | (2006.01) |

(Continued)

(52) U.S. Cl.

CPC ..... *F01D 25/24* (2013.01); *F01D 25/14* (2013.01); *F04D 29/083* (2013.01); *F04D 29/102* (2013.01); *F04D 29/4206* (2013.01); *F05D 2220/40* (2013.01); *F05D 2230/642* (2013.01)

(58) Field of Classification Search

CPC ..... F01D 25/14; F01D 25/24; F04D 29/083; F04D 29/102; F04D 29/4206; F04D 27/0246; F05D 2220/40; F05D 2230/642

USPC ..... 415/182.1, 177, 202, 199.1, 199.2; 277/431, 408, 432; 417/406

See application file for complete search history.

(56) References Cited

U.S. PATENT DOCUMENTS

| | | | | |
|---|---|---|---|---|
| 2,888,193 | A * | 5/1959 | Greenwald | 415/199.1 |
| 3,044,684 | A * | 7/1962 | Fullemann | 415/199.2 |
| 3,173,255 | A * | 3/1965 | Kronogard | 60/791 |

(Continued)

FOREIGN PATENT DOCUMENTS

| | | | |
|---|---|---|---|
| CN | 2572072 | Y | 9/2003 |
| DE | 10692 | A | 10/1955 |

(Continued)

*Primary Examiner* — Thai Ba Trieu

(57) ABSTRACT

A casing is provided having a longitudinal axis of a turbomachine, the axis extending along a rotor. The casing includes at least one jacket part extending along the longitudinal axis and at least one end-face cover. The cover is surrounded by the jacket part at least with a part of the axial extension of the cover. In order to reduce the need for radial clearance, without compromising the availability or safety of the operation of the machine, the cover has radial clearance with respect to the jacket part and at least two separate guide elements of the cover are provided on the jacket part in two different circumferential positions with respect to the longitudinal axis. The respective guide elements are designed such that they block a respective movement of the cover in the circumferential direction at least unidirectionally.

10 Claims, 4 Drawing Sheets

(51) Int. Cl.
*F04D 29/10* (2006.01)
*F04D 29/42* (2006.01)

(56) References Cited

U.S. PATENT DOCUMENTS

| | | | | | |
|---|---|---|---|---|---|
| 3,375,014 | A | * | 3/1968 | Chubb et al. | 277/408 |
| 3,427,000 | A | | 2/1969 | Scalzo | |
| 3,506,375 | A | * | 4/1970 | Endress | 417/13 |
| 3,592,557 | A | * | 7/1971 | Haas | F01D 25/265 415/108 |
| 3,809,493 | A | * | 5/1974 | Pilarczyk | 415/122.1 |
| 4,756,673 | A | * | 7/1988 | Miyashita et al. | 417/400 |
| 4,822,240 | A | | 4/1989 | Marshall | |
| 5,104,284 | A | * | 4/1992 | Hustak et al. | 277/432 |
| 5,718,560 | A | * | 2/1998 | Lorenzen | 277/361 |
| 6,959,929 | B2 | * | 11/2005 | Pugnet et al. | 277/408 |
| 7,594,795 | B2 | * | 9/2009 | Kriz | F01D 25/243 415/213.1 |
| 9,004,857 | B2 | * | 4/2015 | Magara | F04D 29/4206 415/213.1 |
| 2013/0106062 | A1 | * | 5/2013 | Hori et al. | 277/431 |
| 2013/0259661 | A1 | * | 10/2013 | Shudo et al. | 415/170.1 |

FOREIGN PATENT DOCUMENTS

| | | | | | |
|---|---|---|---|---|---|
| DE | 3100039 | A1 | | 12/1981 | |
| EP | 1069313 | A2 | | 1/2001 | |
| EP | 1933038 | A1 | | 6/2008 | |
| FR | 593316 | A | | 8/1925 | |
| GB | 1010300 | A | | 11/1965 | |
| JP | 56054996 | A | * | 5/1981 | F04D 29/08 |
| JP | 56098600 | A | * | 8/1981 | F01D 25/24 |
| JP | 56104198 | A | * | 8/1981 | F01D 25/24 |
| JP | 56104199 | A | * | 8/1981 | F01D 25/24 |
| JP | 58146770 | A | * | 9/1983 | F16J 15/34 |
| JP | 2005351185 | A | * | 12/2005 | F04D 29/08 |
| WO | WO 2009143213 | A2 | | 11/2009 | |

* cited by examiner

CENTERING ATTACHMENT OF A COMPRESSOR HOUSING COVER

CROSS REFERENCE TO RELATED APPLICATIONS

This application is the U.S. National Stage of International Application No. PCT/EP2011/066485, filed Sep. 22, 2011 and claims the benefit thereof. The International Application claims the benefits of German application No. 102010041210.4 DE filed Sep. 22, 2010. All of the applications are incorporated by reference herein in their entirety.

FIELD OF INVENTION

The invention relates to a casing with a longitudinal axis of a turbomachine extending along a rotor, in particular a turbocompressor casing, including at least one jacket part which extends along the longitudinal axis and at least one end-face cover, which cover is surrounded by the jacket part at least by way of part of its axial extension.

BACKGROUND OF INVENTION

These types of casings are used in conjunction with almost any turbo-machine irrespective of whether the turbo-machine is axially traversed or radially traversed. Said designs are additionally conceivable for turbo-machines with a horizontally divided casing or for barrel-type turbo-machines or for turbo-machines with a vertical parting line. Both in the case of expanding turbo-machines and in the case of compressing turbo-machines, the pressures and temperatures of the process fluid are decisively important to the design and the dimensioning, in particular of the casing. The places which enable access to the interior of the casing, that is, for example, parting lines or opening possibilities which are closable in a different manner, for example end-faces covers, form a natural weak point of the casing. A further weak point of the casing and of the overall structure is frequently provided as a result of passages of the rotor through the casing, which have to be sealed by means of a shaft seal. Shaft seals are frequently regions which have a radial clearance which is to be reduced where possible in relation to the shaft so that an anticipated leakage of the process fluid is small. However, the radial clearances cannot be reduced arbitrarily as the thermal load of the casing and of the remaining machine components, in particular in the case of non-stationary operation, is not the same for all machine components and consequently thermal relative expansion occurs—also caused by different materials—which can result in a clearance reduction. In addition, radial clearance requirements from the rotor dynamics and necessary production tolerances have to be taken into account. Only when the sum of the radial clearance requirements plus a safety margin are reflected in the design is the operational safety of the machine actually guaranteed.

DE3100039A1 makes known an alignment of a cover in a circumferential direction of a longitudinal axis.

U.S. Pat. No. 4,822,240 shows a barrel casing, the cover of which carries a bearing and a seal.

FR 593 316 A and GB 1010300 A disclose in each case the bearing arrangement for an internal casing in an external casing.

SUMMARY OF INVENTION

The object of the invention, consequently, is to develop the casing of the abovementioned type further in such a manner that the radial clearance requirement is reduced without making cuts in the availability or the safety of the operation of the machine.

The above object is achieved by the features of the independent claim(s).

Conventional attachments of a cover on the jacket element provide a mounting for the cover by means of screws in the radial direction. In this respect, it is also expedient in the sense as claimed in the invention when the cover has at least one shoulder, which protrudes radially, preferably extends in the circumferential direction and is supported from the inside on a shoulder of the casing, which also protrudes radially inward and also preferably extends in the circumferential direction, in the region of the opening in such a manner that in the case of an excessive pressure in the casing, the cover is pressed to abut fixedly against the jacket element of the casing, the two radial shoulders abutting against one another. The abutment by means of the radial shoulders, such as, for example, shown in EP 1 933 038 A1, solves the problem of the cover attachment on the jacket part against the effect of the internal pressure, for example in the case of a compressor. Completely untouched, however, remains the problem of centering the cover in the radial direction. This is particularly serious because in this case the cover is the carrier of shaft seals and of a radial bearing for a rotor which is guided right through an opening in the cover. Realizing the cover in this case as a carrier for all components which are relevant for radial clearance has the superb advantage that the tolerance chain, with reference to said components which are relevant for radial clearance, is shortened a great deal such that a radial clearance requirement which is already reduced is produced. An arrangement of this type is particularly sensitive with regard to incorrect radial alignments of the cover such that in this case an application of the invention is particularly expedient. The invention consists in that the cover experiences a centering process in relation to the casing. As already explained above, the cover cannot be aligned with respect to the jacket element by means of a centering fit in the region of the overlapping axial extension, as at said position a relatively small clearance is to be provided in order to ensure a thermal relative expansion in particular during non-stationary operation but also under stationary operating conditions. The invention makes possible, on the one hand, a relative movement of regions of the cover in relation to the jacket part, in particular as a result of thermal relative expansion and, on the other hand, a centering of the cover with respect to the jacket part of the casing in other regions. The cover is preferably centered with respect to the jacket part of the casing in the region which defines the point of intersection between the longitudinal axis and the cover.

An advantageous further development provides that the two guide elements are arranged such that they support the force due to the weight of the cover. Support of this type is also very useful within the framework of assembly because no provisional supporting means have to be provided for a cover of this type.

In addition, it is advantageous when the cover has formations which support the force due to the weight of the cover in recesses at the parting line of the casing. Said recesses are developed in an expedient manner such that the formations on the cover restrict a vertical movement in a bidirectional manner.

In this way, forces on the cover brought about, for example, by frictional forces can neither move the cover vertically downward nor vertically upward.

In addition, it is expedient when a centering means is provided on the casing which has two supporting faces which abut against contact faces of the cover, wherein the supporting faces and contact faces are realized in such a manner that a horizontal movement of the cover COV perpendicular with respect to the longitudinal axis AX is blocked only on both sides. Otherwise the mobility is not restricted by the centering means itself.

The centering means, which is arranged through the longitudinal axis along a vertical, should block the mobility perpendicular with respect to the longitudinal axis in a horizontal direction in a bidirectional manner. In a preferred manner, the two guides only have one supporting face on the cover and the centering means has two supporting faces with respect to the cover.

A preferred field of application of the invention is for covers with an outside diameter of 1000 mm or more. In a particularly expedient manner, the guide elements are realized in such a manner that in operation the radial clearance is produced substantially concentrically with respect to the longitudinal axis. In this way, rotor-dynamic considerations can dominate the design of the radial clearance. The term operation in this respect refers to the design-specific operation under rated conditions and not to a transient state for example during the acceleration or deceleration of the machine. Particularly expedient is an arrangement of the two guide elements along a horizontal which extends through the longitudinal axis.

The invention is particularly expedient in the case of large covers (diameter in excess of 1000 mm), in particular when the cover has a first supporting face which extends in the circumferential direction and cooperates in a sealing manner with a second supporting face on the jacket part, wherein in a preferred manner attachment elements are provided for attaching the cover to the jacket part and to the cover, wherein a surface normal of the second supporting face points into the interior of the casing and a surface normal of the first supporting face is directed in the opposite direction such that an excessive pressure in the interior of the casing presses the two supporting faces against one another.

In a preferred manner, the two guide elements, which are arranged through the longitudinal axis along a horizontal, can be guide elements which block mobility in the vertical at least in a unidirectional manner, in particular support the cover against the gravitational force.

In an expedient manner, two horizontal supports are provided on the jacket part, by means of which horizontal supports the cover is supported against the effect of gravitation and additionally in an expedient manner a guide is provided on the jacket part, said guide blocking a movement of the cover in the horizontal direction perpendicular with respect to the longitudinal axis of the jacket part. The two guide elements, which are realized as horizontal supports, together with the longitudinal axis of the machine part define a plane. The third guide, which blocks a horizontal movement perpendicular with respect to the longitudinal axis of the jacket part on both sides, has on corresponding contact faces of the cover abutting supporting faces which, in a preferred manner, are no further than 20 mm away from a common vertical plane through the longitudinal axis of the jacket part.

As already detailed above, in a preferred manner the cover is the carrier of at least one shaft seal which seals a circumferential gap between the rotor and the cover at the opening. In addition, in an expedient manner the cover can be the carrier of a radial bearing for the bearing arrangement of the rotor. In a particularly preferred manner, the shaft seal includes a dry gas seal. In particular in the case where the shaft seal includes a dry gas seal, the cover is advantageously provided with a heating means which, in the event of particularly cold process gases, heats the dry gas seal to a suitable operating temperature. For example, in the case of a boil off gas application, compression takes place at −160° C. such that the dry gas seal has to be heated to a suitable operating temperature of for instance −100° C. by means of the heating means incorporated in the cover.

The invention provides that the casing has a horizontal parting line parallel to the longitudinal axis.

BRIEF DESCRIPTION OF THE DRAWINGS

The invention is described in more detail below by way of a special exemplary embodiment with reference to drawings. Further realization possibilities of the invention are produced for the expert along with the exemplary embodiment in particular by combining the sub-claims with the main claim in an arbitrary manner The drawings are as follows:

DETAILED DESCRIPTION OF INVENTION

Figure 1:
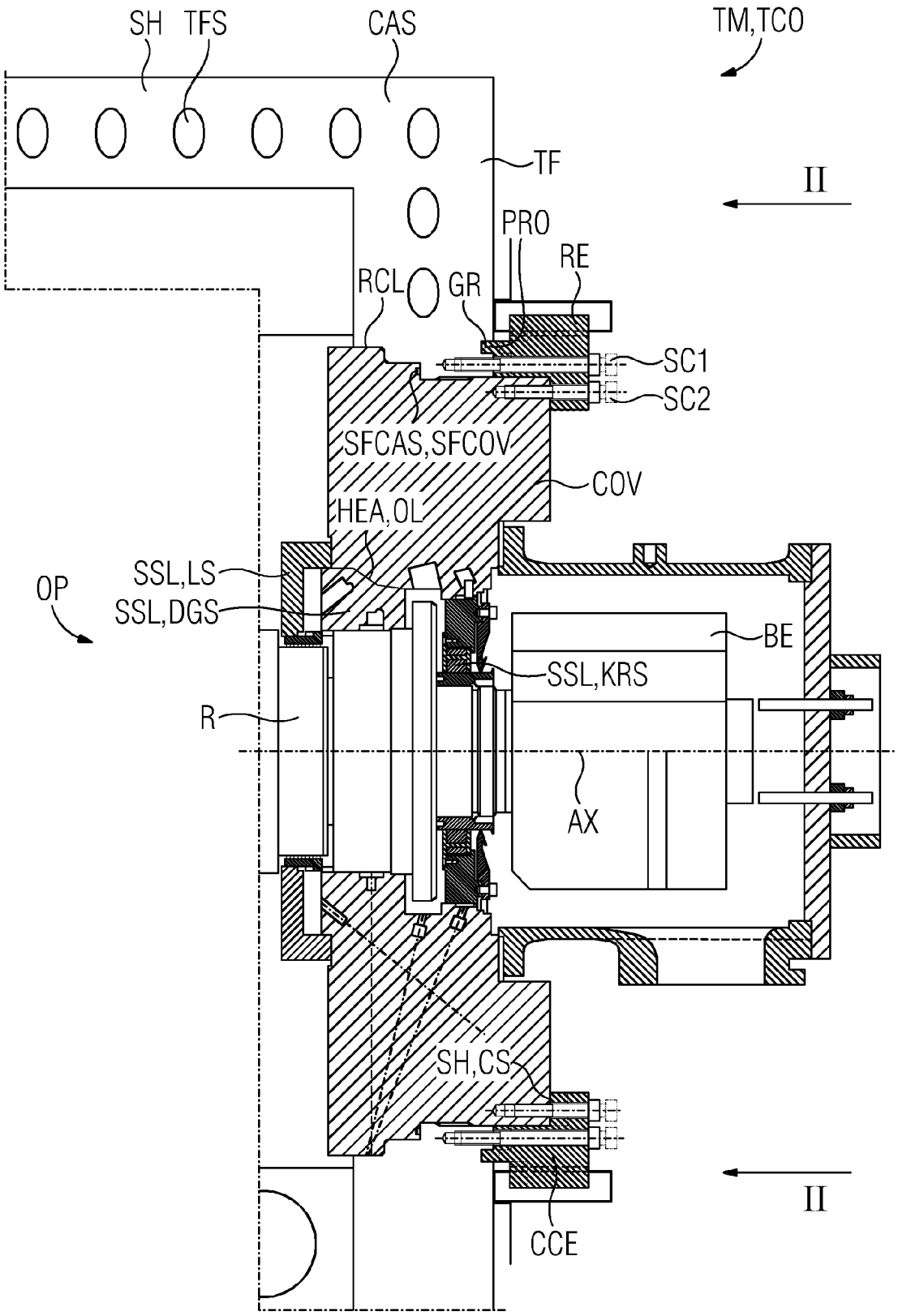
FIG. 1 shows a longitudinal section through part of a turbo-compressor showing essential parts of a casing as claimed in the invention.

FIG. 1 shows a turbo-machine TM, namely a turbo-compressor TCO with a casing CAS or a turbo-compressor casing as claimed in the invention. The casing CAS extends along a longitudinal axis AX and has a horizontal parting line TF which is held together by means of parting line screws TFS. The casing CAS can be divided into a jacket part SH and a cover COV. The jacket part SH is provided with the horizontal parting line TF. The cover COV is realized in a non-divided manner and has a substantially level extension perpendicular with respect to the longitudinal axis AX with a substantially round outer contour. In a substantially concentric manner with respect to the round outer contour, in the region about a longitudinal axis of the jacket part SH, the cover has an opening OP, through which a rotor R, which extends along the longitudinal axis AX, is guided right out of the casing CAS. The cover COV carries a shaft seal SSL and a radial bearing BE. The shaft seal SSL includes, proceeding from the interior of the machine in an axial sequence, a labyrinth seal LS, a dry gas seal DGS and a carbon ring seal KRS. The turbo-compressor TCO is provided for compressing boil off gas, which involves process gas at temperatures which are approximately −160° C. In order to provide a suitable operating temperature of >−100° C. for the dry gas seal, a heating means HEA is incorporated in the cover COV, said heating means adjoining the dry gas seal DGS. The heating means HEA is operated with oil OL as the heat exchanging medium.

Figure 3:
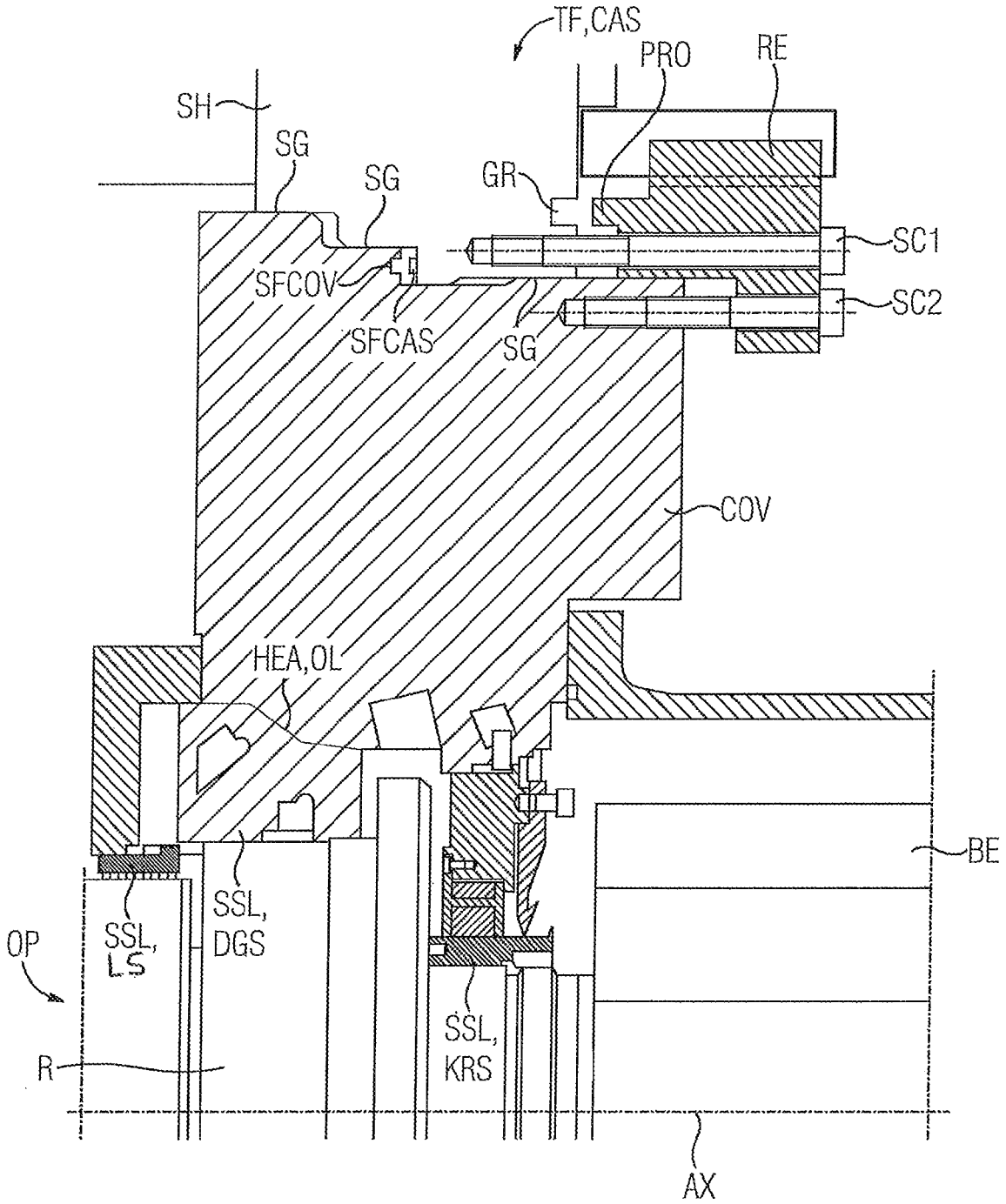
FIG. 3 shows a view of a detail from FIG. 1 in assembly.
Figure 4:
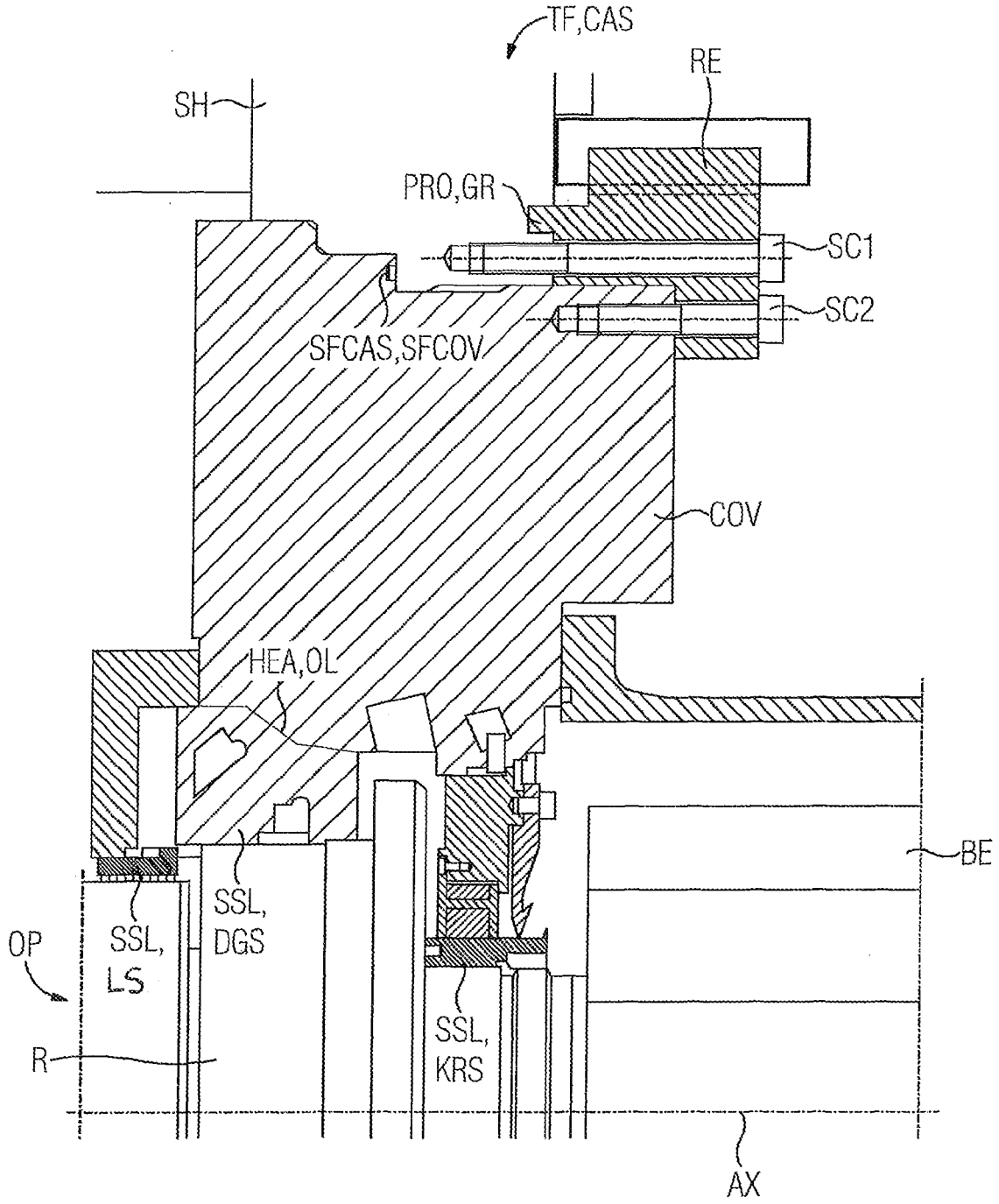
FIG. 4 shows a view of a detail from FIG. 1 in operation.

As shown in FIGS. 3 and 4, the cover COV includes a bottom element BE and a ring element RE which is screw-connected to the casing CAS from outside by means of first screws SC1, framing the cover COV. The ring element RE has a formation PRO which extends in the circumferential direction and during assembly is inserted in a groove GR which extends in the circumferential direction (FIG. 3 and FIG. 4). The ring element RE is adapted to the outer contour of the cover COV on the side pointing to the outside and is screw-connected in a fixed manner to the cover COV by means of second screws SC2. In operation, the screw connection of the ring element RE by means of the screw SC1 on the jacket part SH of the casing CAS by means of the screw SC1 also has a radial clearance, as the positive locking formed by the formation PRO and the groove GR. A radial alignment of the cover COV in relation to the jacket part SH is effected by means of two guides GE and one centering means CCE. The two guides GE form in each case a horizontal support SUPH which supports the cover COV in the region of the horizontal parting line TF against a force due to weight G. The centering means CCE is a horizontal centering means and blocks a movement of the cover COV perpendicular with respect to the longitudinal axis AX of the jacket part SH in the horizontal direction. The horizontal supports SUPH prevent a movement of the cover COV in the vertical direction against the force due to weight G only on one side.

Figure 2:
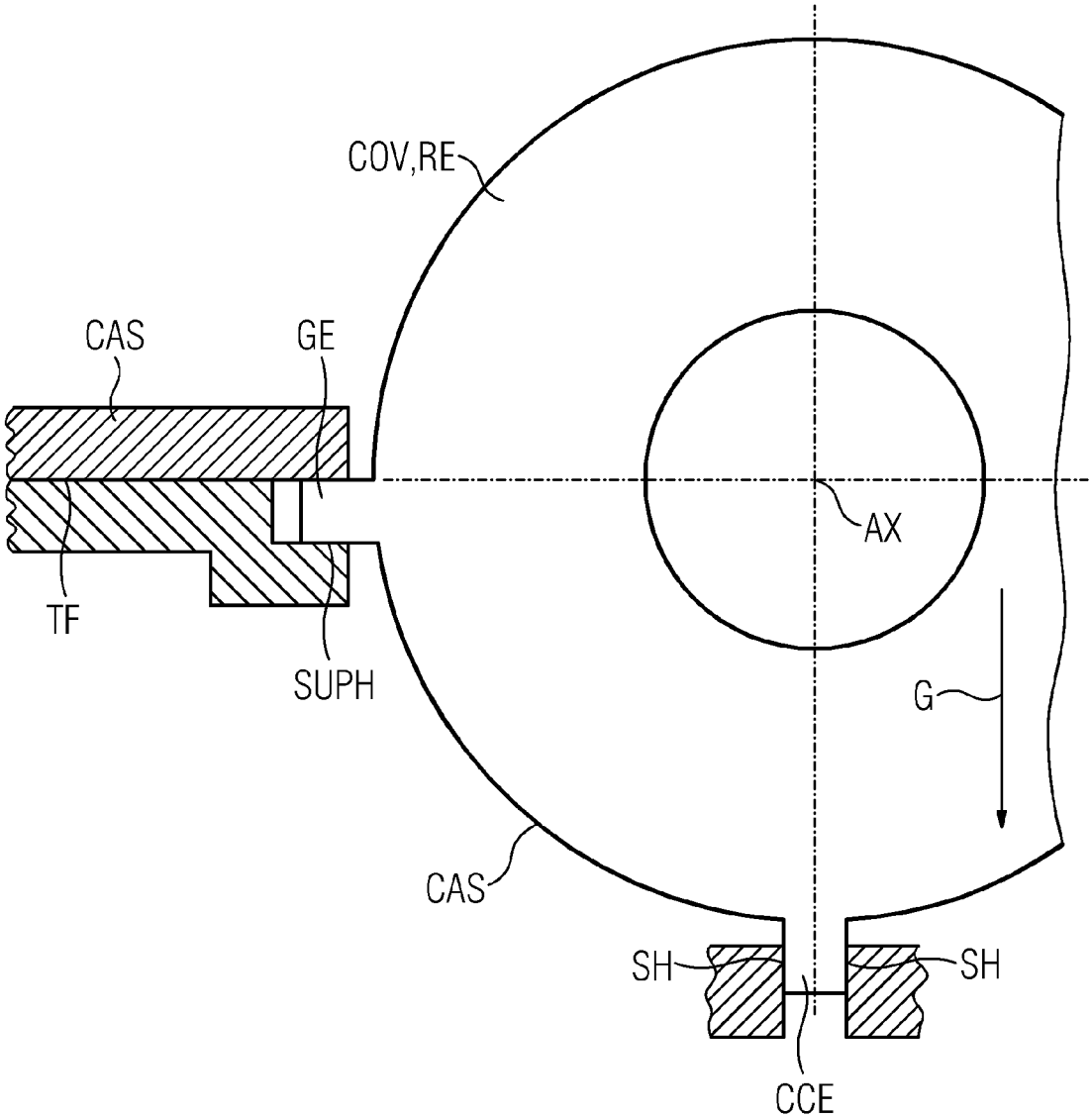
FIG. 2 shows a view of the turbo-compressor identified by means of II in FIG. 1.

The centering means CCE blocks a horizontal movement perpendicular with respect to the steering axis AX on both sides; it has two supporting faces SH which abut against contact faces CS of the ring element RE which is associated with the cover COV. The centering guide CCE, which can also be designated as a horizontally acting centering element, is realized with the supporting faces SH and the contact faces CS of the ring element RE in pairs in each case such that the supporting faces SH are no further than 10 mm away from a vertical plane through the longitudinal axis AX. In addition, the horizontal supports SUPH define a horizontal plane together with the longitudinal axis AX. Said geometric interrelationships are shown in FIG. 2.

The cover COV has a radial clearance RCL in relation to the jacket part SH.

The cover COV has a first contact face SFCOV which extends in the circumferential direction and interacts in a sealing manner with a second supporting face SFCAS on the jacket part SH, wherein a surface normal of the second supporting face SFCAS points into the interior of the casing CAS and a surface normal of the first supporting face SFCOV is directed in the opposite direction such that an excessive pressure in the interior of the casing CAS presses the two supporting faces SFCAS, SFCOV against one another.

The invention claimed is:

1. A casing with a longitudinal axis of a turbomachine extending alon a rotor the casin comprising:

at least one jacket part which extends along the longitudinal axis, and at least one end-face cover, wherein the casing has a horizontal parting line parallel to the longitudinal axis, which cover is surrounded by the jacket part at least by way of part of its axial extension, wherein the cover has a radial clearance in relation to the jacket part and in that at least two separate guide elements of the cover are provided on the jacket part at two different circumferential positions with reference to the longitudinal axis, wherein the at least two separate guide elements are respectively configured in such a manner that they block a movement of the cover in the circumferential direction at least in a unidirectional manner, wherein a centering device is provided on the casing, the centering device having two supporting faces which abut against contact faces of the cover, wherein the supporting faces and contact faces are configured in such a manner that a horizontal movement of the cover perpendicular with respect to the longitudinal axis is blocked in a bidirectional manner, and wherein the cover includes at least one shaft seal, via which a circumferential gap between the rotor and the opening of the cover is sealable.

2. A casing with a longitudinal axis of a turbomachine extending along a rotor, the casing comprising:

at least one jacket part which extends along the longitudinal axis, and at least one end-face cover, wherein the casing has a horizontal parting line parallel to the longitudinal axis, which cover is surrounded by the jacket part at least by way of part of its axial extension, wherein the cover has a radial clearance in relation to the jacket part and in that at least two separate guide elements of the cover are provided on the jacket part at two different circumferential positions with reference to the longitudinal axis, wherein the at least two separate guide elements are respectively configured in such a manner that they block a movement of the cover in the circumferential direction at least in a unidirectional manner, wherein a centering device is provided on the casing, the centering device having two supporting faces which abut against contact faces of the cover, wherein the supporting faces and contact faces are configured in such a manner that a horizontal movement of the cover perpendicular with respect to the longitudinal axis is blocked in a bidirectional manner, and wherein the cover has a first supporting face which extends in the circumferential direction and cooperates in a sealing manner with a second supporting face on the jacket part, wherein a surface normal of the second supporting face points into the interior of the casing and a surface normal of the first supporting face is directed in the opposite direction such that an excessive pressure in the interior of the casing presses the two supporting faces against one another.

3. A casing with a longitudinal axis of a turbomachine extending along a rotor, the casing comprising:

at least one jacket part which extends along the longitudinal axis, and at least one end-face cover, wherein the casing has a horizontal parting line parallel to the longitudinal axis, which cover is surrounded by the jacket part at least by way of part of its axial extension, wherein the cover has a radial clearance in relation to the jacket part and in that at least two separate guide elements of the cover are provided on the jacket part at two different circumferential positions with reference to the longitudinal axis, wherein the at least two separate guide elements are respectively configured in such a manner that they block a movement of the cover in the circumferential direction at least in a unidirectional manner, wherein a centering device is provided on the casing, the centering device having two supporting faces which abut against contact faces of the cover, wherein the supporting faces and contact faces are configured in such a manner that a horizontal movement of the cover perpendicular with respect to the longitudinal axis is blocked in a bidirectional manner, and wherein the casing is a turbo-compressor casing.

4. The casing as claimed in claim 3, wherein the cover has an opening for positioning the rotor extending through the opening axially.

5. The casing as claimed in claim 3, wherein the at least two separate guide elements are arranged and configured such that they support the force due to the weight of the cover.

6. The casing as claimed in claim 3, wherein the at least two separate guide elements are arranged in such a manner that in operation the clearance is produced concentrically with respect to the longitudinal axis.

7. The casing as claimed in claim 5, wherein the at least two separate guide elements are arranged through the longitudinal axis along a horizontal and the centering device is arranged through the longitudinal axis along a vertical.

8. The casing as claimed in claim 3, wherein the cover includes a radial bearing.

9. The casing as claimed in claim 1, wherein the shaft seal included by the cover includes a dry gas seal.

10. The casing as claimed in claim 3, wherein the at least two separate guide elements block a free vertical movement of the cover only on one side and the centering device blocks a horizontal free movement perpendicular with respect to the longitudinal axis of the cover in a bidirectional manner.

* * * * *